US008602723B2

(12) United States Patent
Chou et al.

(10) Patent No.: US 8,602,723 B2
(45) Date of Patent: Dec. 10, 2013

(54) HEAT DISSIPATING BLOWER

(75) Inventors: Chia-Shin Chou, Taipei Hsien (TW); Xiao-Zhu Chen, Shenzhen (CN); Zhen-Xing Ye, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 906 days.

(21) Appl. No.: 12/730,243

(22) Filed: Mar. 24, 2010

(65) Prior Publication Data

US 2011/0083832 A1 Apr. 14, 2011

(30) Foreign Application Priority Data

Oct. 14, 2009 (CN) ..... 2009 1 0308274

(51) Int. Cl.
*F04D 29/40* (2006.01)

(52) U.S. Cl.
USPC ..... 415/126; 415/182.1

(58) Field of Classification Search
USPC ..... 415/126, 127, 148, 212.1, 182.1, 208.1, 415/211.2, 224
See application file for complete search history.

(56) References Cited

U.S. PATENT DOCUMENTS

| | | | | |
|---|---|---|---|---|
| 491,407 | A * | 2/1893 | Davis | 415/151 |
| 2,649,242 | A * | 8/1953 | Payne | 415/52.1 |
| 5,697,841 | A * | 12/1997 | Di Giovine | 454/290 |
| 8,197,193 | B2 * | 6/2012 | Messmer | 415/126 |
| 8,206,099 | B2 * | 6/2012 | Tsai et al. | 415/206 |

FOREIGN PATENT DOCUMENTS

| | | | |
|---|---|---|---|
| JP | 2002161896 | A | 6/2002 |
| WO | WO 02065866 | A1 * | 8/2002 |

* cited by examiner

*Primary Examiner* — Nathaniel Wiehe
*Assistant Examiner* — Ryan Ellis
(74) *Attorney, Agent, or Firm* — Altis Law Group, Inc.

(57) ABSTRACT

A heat dissipating blower includes a main body and a cover. The main body includes a shell and a fan. An outlet and a first gap are defined in the shell. A connecting portion is set at one end of the first gap away from the outlet. Two sliding grooves are formed on inner surfaces of a first wall and a second wall and a plurality of locating holes is set on the two sliding grooves. The cover includes two parallel side plates and a middle plate. A plurality of positioning pins is set on outer surfaces of the two side plates. Some of the positioning pins are located in corresponding ones of the locating holes to change an area of the outlet.

7 Claims, 4 Drawing Sheets

HEAT DISSIPATING BLOWER

BACKGROUND

1. Technical Field

The present disclosure relates to a heat dissipating blower.

2. Description of Related Art

A conventional blower in an enclosure such as for a server or computer often has a fixed outlet. Users can not change the area of outlet to meet different demands of heat dissipation.

DETAILED DESCRIPTION

Figure 1:
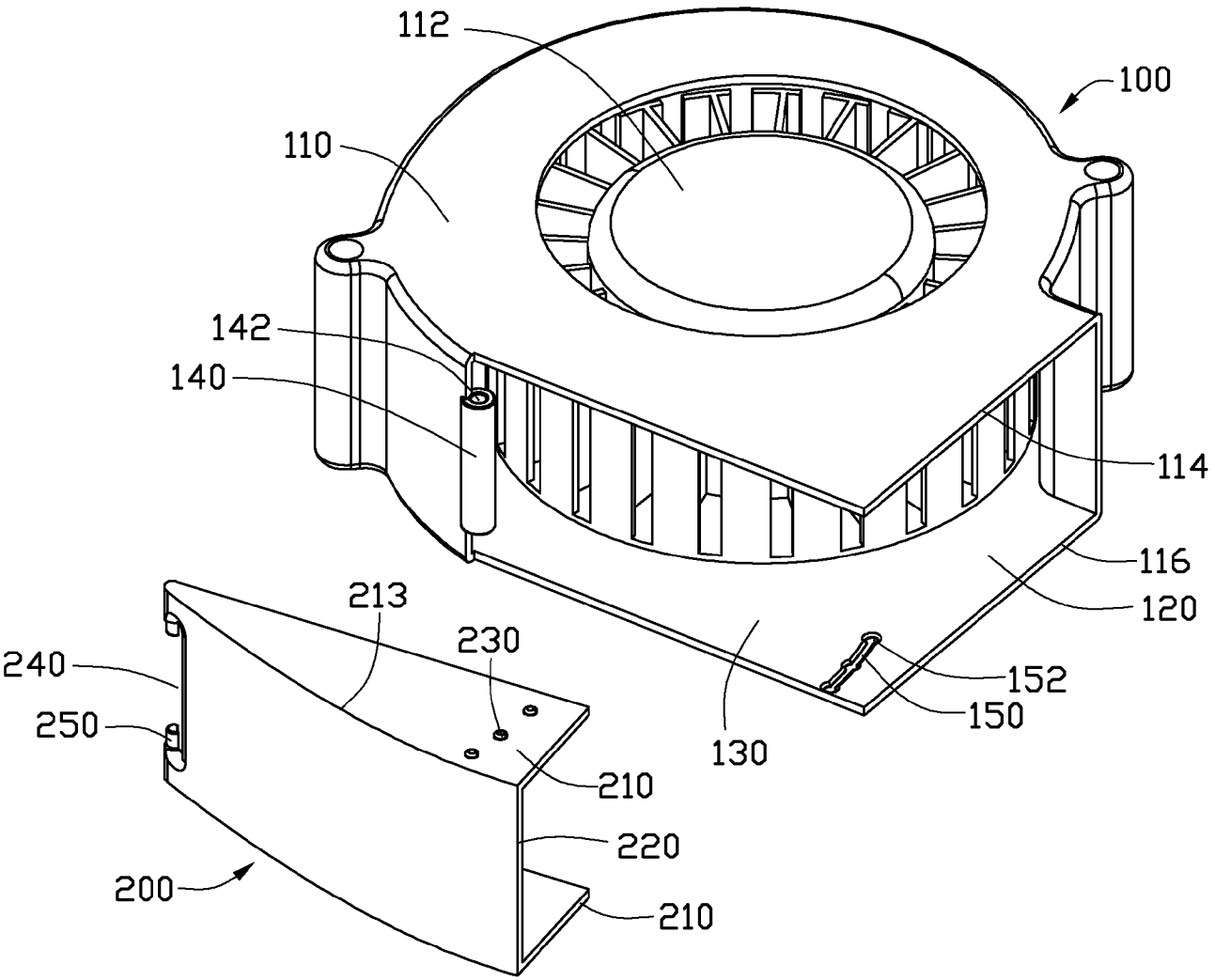
FIG. 1 is an exploded, isometric view of an exemplary embodiment of a heat dissipating blower.

Referring to FIG. 1, an exemplary embodiment of a heat dissipating blower includes a main body 100 and a cover 200.

The main body 100 includes a shell 110 and a fan 112 inside the shell 110.

The shell 110 includes a first wall 114 and a second wall 116 opposite and parallel to the first wall 114 to sandwich the fan 112 therebetween. An outlet 120 is defined in the shell 110 between the first and second walls 114 and 116, at a side of the shell 110. A first gap 130 is defined in the shell 110 beside and communicating with the outlet 120. A column-shaped connecting portion 140 is set on the shell 110 at an end of the first gap 130 away from the outlet 120. A slot 142 is axially defined in the connecting portion 140.

Two arc-shaped sliding grooves 150 are formed on inner surfaces of the first wall 114 and the second wall 116, respectively. A plurality of locating holes 152 is defined in the two sliding grooves 150.

The cover 200 includes two parallel side plates 210 and a middle plate 220 perpendicularly connected between corresponding edges 213 of the two side plates 210. The shape of each side plate 210 is nearly a triangle. The edges 213 of the side plates 210 connected to the middle plate 220 are arced. The distance between the two side plates 210 is a little less than the distance between the first wall 114 and the second wall 116 of the shell 110, to make sure that the cover 200 can be accommodated in the first gap 130 of the shell 110.

A plurality of positioning pins 230 is set on the outer surfaces of the two side plates 210, adjacent to great ends of the side plates 210.

A second gap 240 is defined at an end of the middle plate 220 away from the plurality of positioning pins 230. Two connecting axes 250 extend from the middle plate 220 towards the second gap 240.

Figure 2:
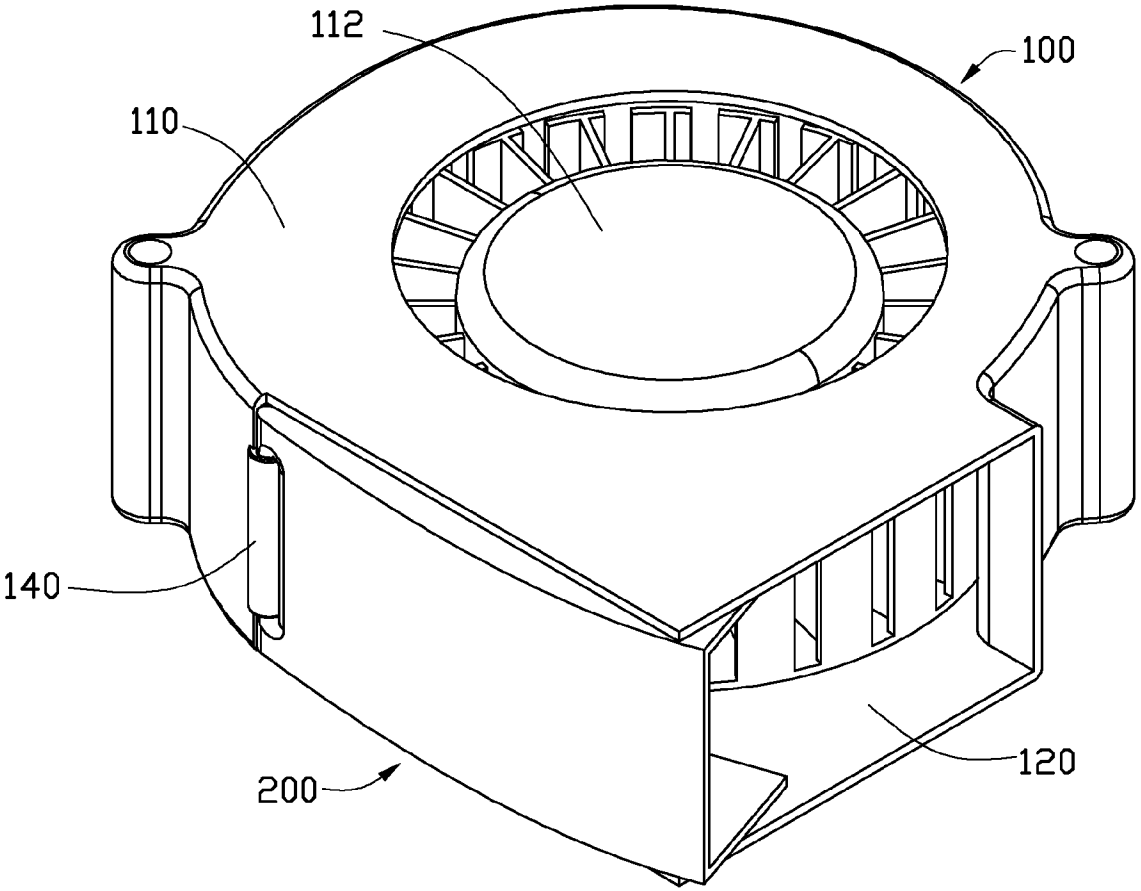
FIG. 2 is an assembled, isometric view of the heat dissipating blower of FIG. 1.
Figure 3:
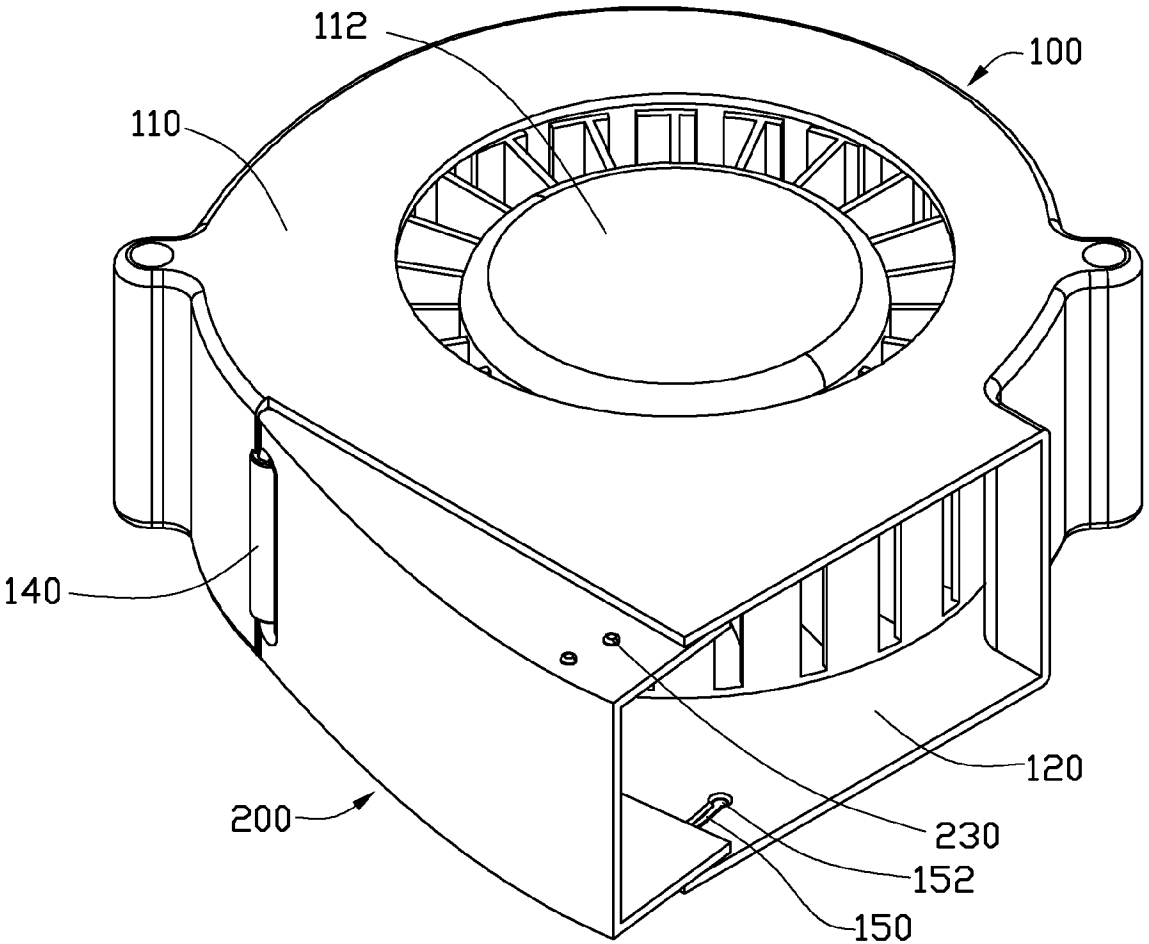
FIG. 3 is similar to FIG. 2, but showing a different using state.

Referring to FIG. 2, in assembly, the two connecting axes 250 are engaged in opposite ends of the slot 142 of the connecting portion 140, to rotatably connect the cover 200 to the shell 110. The cover 200 is rotated to cover the first gap 130, with the two side plates 210 of the cover 200 accommodated in the first gap 130 and sandwiched by the first and second walls 114 and 116 of the shell 110. Some of the positioning pins 230 can be engaged in the corresponding locating holes 152 of the two sliding grooves 150. For example, the cover 200 can be rotated out so that only one of the positioning pins 230 of each side plate 210 away from the middle plate 220 can be engaged in a corresponding one of the locating holes 152 away from the fan 112, so that the cover 200 is locked in a most extended position thus creating a largest output area 120. The cover 200 can be rotated in a little to allow two of the positioning pins 230 of each side plate 210 away from the middle plate 220 to be engaged in two locating holes 152 away from the fan 112, thus locking the cover 200 in a middle position creating a medium outlet area 120. The cover 200 can be further rotated in to allow all the positioning pins 230 of each side plate 210 to be engaged in the corresponding locating holes 152 creating a smallest outlet area 120. In FIG. 2, the smallest outlet area 120 is shown; with all of the positioning pins 230 located in the corresponding locating holes 152. In FIG. 3, the largest outlet area 120 is shown; with only one positioning pin 230 of each side plate 210 is located in the corresponding locating hole 152. In other embodiments there can be the number of holes and pins can be set to allow just two positions or more than three positions to adjust the outlet area 120 depending on requirements.

Figure 4:
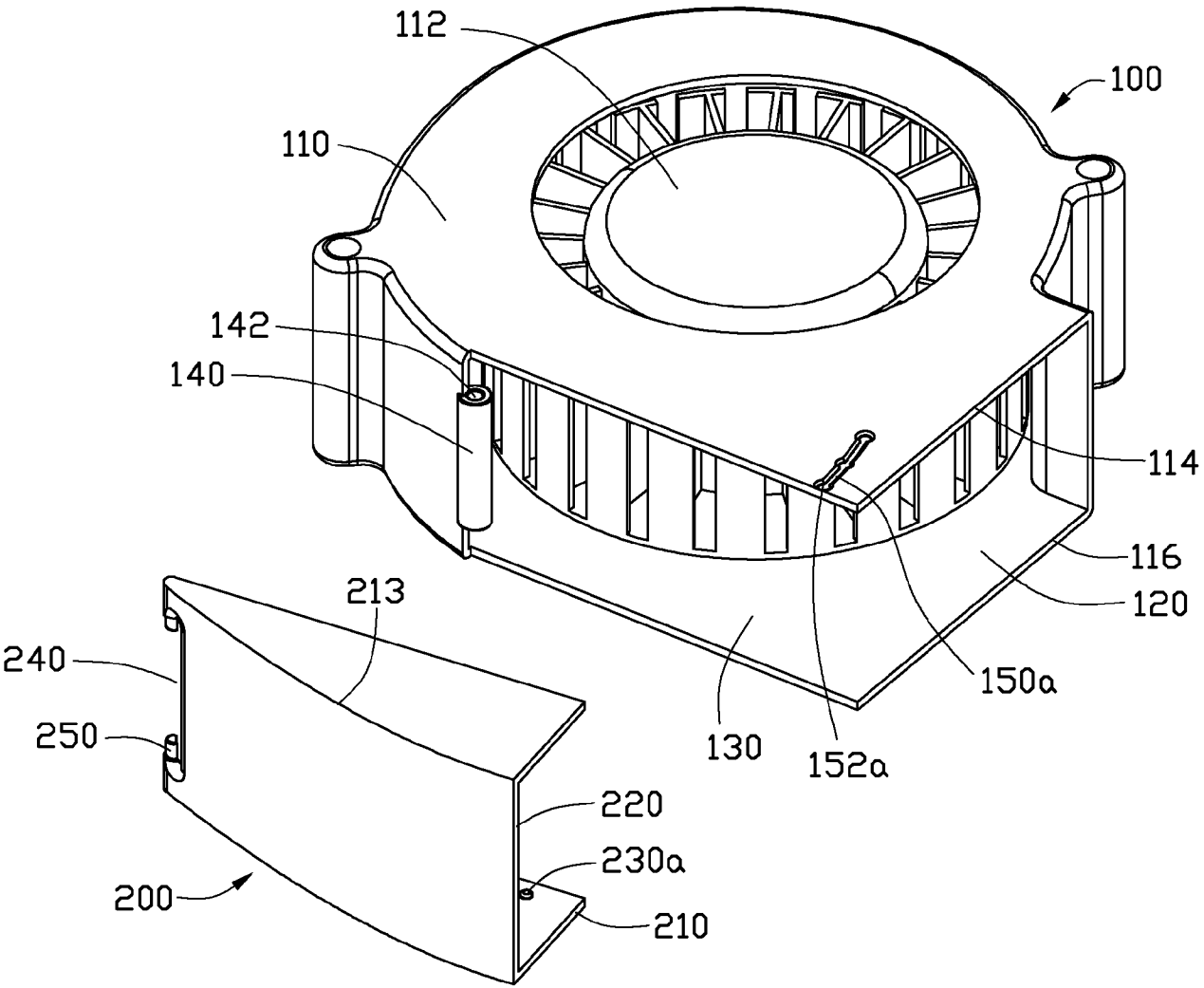
FIG. 4 is an exploded, isometric view of another embodiment of a heat dissipating blower.

Referring to FIG. 4, in another embodiment, the distance between the two side plates 210 is greater than the distance between the first wall 114 and the second wall 116. Two arc-shaped sliding grooves 150*a* are formed on the outer surfaces of the first wall 114 and the second wall 116. A plurality of locating holes 152*a* is set on the two sliding grooves 150*a*. A plurality of positioning pins 230*a* is set on the inner surfaces of the two side plates 210.

The foregoing description of the exemplary embodiments of the disclosure has been presented only for the purposes of illustration and description and is not intended to be exhaustive or to limit the disclosure to the precise forms disclosed. Many modifications and variations are possible in light of the above. The embodiments were chosen and described in order to explain the principles of the disclosure and their practical application so as to enable others of ordinary skill in the art to utilize the disclosure and various embodiments and with various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than the foregoing description and the exemplary embodiments described therein.

What is claimed is:

1. A heat dissipating blower, comprising:

a main body comprising a shell and a fan inside the shell, wherein the shell comprises a first wall and a second wall spaced from and facing the first wall, an outlet and a first gap are defined between the first wall and the second wall, and the first gap is defined beside and communicates with the outlet, a connecting portion is set at one end of the first gap away from the outlet, two sliding guiding structures are formed on inner surfaces of the first wall and the second wall, a plurality of locating holes is set on the two sliding guiding structures; and a cover connected to the connecting portion of the main body, and comprising two parallel side plates and a middle plate connected between the two side plates, wherein a plurality of positioning pins is set on outer surfaces of the two side plates, the distance between the two side plates is less than the distance between the first wall and the second wall to make sure that the cover is accommodated in the first gap, some of the plurality of positioning pins are located in corresponding ones of the locating holes to change an area of the outlet.

2. The heat dissipating blower of claim 1, wherein a second gap is defined in an end of the middle plate away from the plurality of positioning pins, two connecting axes are set at two ends of the second gap, a slot is defined in the connecting portion of the shell, the connecting axes of the cover are rotatably engaged in opposite ends of the slot of the connecting portion.

3. The heat dissipating blower of claim 1, wherein the two sliding guiding structures are two sliding grooves, the two sliding grooves are arc-shaped.

4. A heat dissipating blower, comprising:

a main body comprising a shell and a fan inside the shell, wherein the shell comprises a first wall and a second wall spaced from and facing the first wall, an outlet and a first gap are defined between the first wall and the second wall, and the first gap is defined beside an communicates with the outlet, connecting portion is set at one end of the first gap away from the outlet, two sliding guiding structures are formed on outer surfaces of the first wall and the second wall, a plurality of locating holes is set on the two sliding guiding structures; and a cover connected to the connecting portion of the main body, and comprising two parallel side plates and a middle plate connected between the two side plates, wherein a plurality of positioning pins is set on inner surfaces of the two side plates, the distance between the two side plates is greater than the distance between the first wall and the second wall to make sure that the first wall and the second wall are accommodated in space between the two side plates, some of the plurality of positioning pins are located in corresponding ones of the locating holes to change an area of the outlet.

5. The heat dissipating blower of claim 4, wherein a second gap is defined in an end of the middle plate away from the plurality of positioning pins, two connecting axes are set at two ends of the second gap, a slot is defined in the connecting portion of the shell, the connecting axes of the cover are rotatably engaged in opposite ends of the slot of the connecting portion.

6. The heat dissipating blower of claim 4, wherein the two sliding guiding structures are two sliding grooves, the two sliding grooves are arc-shaped.

7. A heat dissipating blower comprising:

a main body comprising a shell and a fan inside the shell, wherein the shell comprising a first wall and a second wall spaced from and facing the first wall, an outlet and a first gap are defined between the first wall and the second wall, the first gap is substantially perpendicular to and communicates with the outlet, a connecting portion is set at one end of the first gap away from the outlet, two sliding guiding structures are formed on the first wall and the second wall at a joint of the outlet and the first gap, and a plurality of locating holes is set on the two sliding guiding structures; and a cover connected to the connecting portion of the main body, and comprising two parallel side plates and a middle plate connected between the two side plates, wherein a plurality of positioning pins is set on the two side plates to selectively engage in corresponding ones of the locating holes thereby to change an area of the outlet.

* * * * *